United States Patent [19]

Watanabe

[11] Patent Number: 4,841,859

[45] Date of Patent: Jun. 27, 1989

[54] SIDE LAY CONTROL APPARATUS FOR SHEET-FED PRINTING PRESS

[75] Inventor: Hideo Watanabe, Toride, Japan

[73] Assignee: Komori Printing Machinery Co., Ltd., Tokyo, Japan

[21] Appl. No.: 275,047

[22] Filed: Nov. 21, 1988

[51] Int. Cl.[4] ..... B41F 13/24

[52] U.S. Cl. ..... 101/233; 400/579; 271/238

[58] Field of Search ..... 101/232, 233, 485; 271/277, 253, 238, 248; 400/579, 706, 708

[56] References Cited

U.S. PATENT DOCUMENTS

| | | | |
|---|---|---|---|
| 2,792,504 | 5/1957 | Scamar et al. | 400/579 |
| 3,020,996 | 2/1962 | DOnofrio | 400/579 |
| 3,763,775 | 10/1973 | Miles | 101/233 |
| 3,951,251 | 4/1976 | Zaccagnino, Jr. | 101/233 |
| 4,438,917 | 3/1984 | Janssen et al. | 400/579 |
| 4,552,065 | 11/1985 | Billington et al. | 101/233 |
| 4,743,129 | 5/1988 | Keryhuel et al. | 400/579 |
| 4,774,446 | 9/1988 | Salazar et al. | 101/233 |

FOREIGN PATENT DOCUMENTS

| | | | |
|---|---|---|---|
| 2950606 | 6/1981 | Fed. Rep. of Germany | 101/233 |
| 2950650 | 6/1981 | Fed. Rep. of Germany | 101/233 |
| 2512743 | 3/1983 | France | 101/233 |
| 55270 | 4/1983 | Japan | 400/579 |
| 220774 | 12/1983 | Japan | 400/579 |
| 134283 | 6/1987 | Japan | 400/579 |

OTHER PUBLICATIONS

"Side-of-Forms, End-of-Forms, and Forms Jam-Detection Scheme for Printers" IBM Tech. Discl. Bulletin, vol. 20, No. 11A, Apr./1978, pp. 4266-4269.

*Primary Examiner*—Eugene H. Eickholt

*Attorney, Agent, or Firm*—Townsend & Townsend

[57] ABSTRACT

A side lay position control apparatus for a sheet-fed printing press, includes a switch for setting a distance from a reference point of the sheet-fed printing press to a side lay and a fine adjustment length with reference to the distance, a CPU for calculating an actual distance from the reference point to the side lay in accordance with the distance from the reference point to the side lay and the fine adjustment length, and a driver for moving the side lay in accordance with the actual distance.

3 Claims, 3 Drawing Sheets

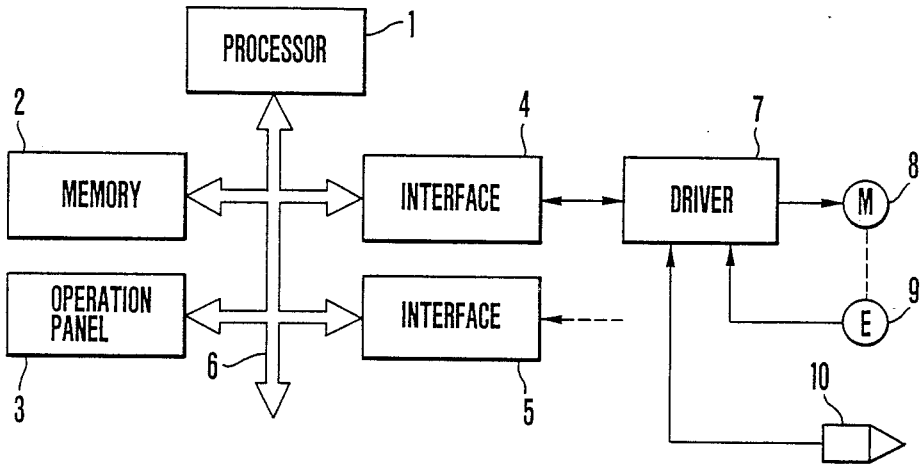
FIG.1
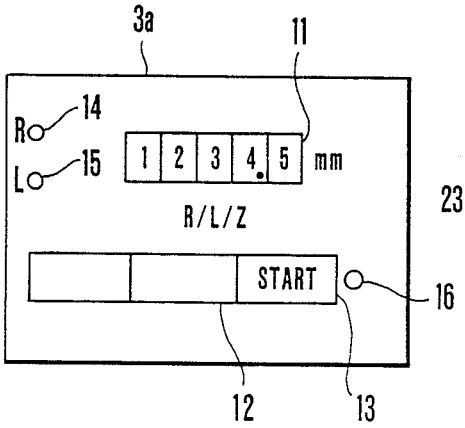
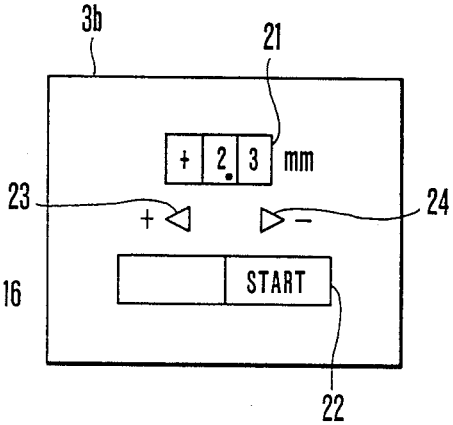
FIG.2
FIG.3

SIDE LAY CONTROL APPARATUS FOR SHEET-FED PRINTING PRESS

BACKGROUND OF THE INVENTION

The present invention relates to an apparatus for performing position control of a side lay used for regulating a right-and-left position of paper fed to a sheet-fed printing press.

In order to determine a right-and-left position of paper and to print an image from a plate to substantially the center of paper, position regulating members, called side lays, are arranged at right and left positions of a sheet-fed printing press, and the side lays are manually moved in accordance with a printing condition to be optimally set.

However, the positions of the side lays are adjusted while performing test printing, and it takes much time. A large amount of paper for test printing is required, resulting in poor economy and cumbersome operations. Recently, along with development of printing techniques, improvement of a printing plate fixing mechanism of a plate cylinder, introduction of an automatic registration adjusting apparatus, and so on, other operations and adjustment are performed at high speed and automated. However, the position setting of the side lays is cumbersome, and its automation is demanded.

SUMMARY OF THE INVENTION

It is therefore an object of the present invention to provide a side lay position control apparatus for a sheet-fed printing press which can automatically adjust side lay positions to shorten a time required for adjustment, save test printing paper and achieve energy saving and high-speed printing operations.

In order to achieve the above object, there is provided a side lay position control apparatus for a sheet-fed printing press, comprising: setting means for setting a distance from a reference point of the sheet-fed printing press to a side lay and a fine adjustment length with reference to the distance; calculating means for calculating an actual distance from the reference point to the side lay in accordance with the distance from the reference point to the side lay and the fine adjustment length; and drive means for moving the side lay in accordance with the actual distance.

According to the present invention, a distance from a reference point to a side lay can be set in accordance with a paper size, and a fine adjustment length can be set in accordance with a printing condition. Therefore, an actual distance from the reference point to the side lay can be automatically calculated, and the side lay is moved in accordance with the calculated actual distance, thus positioning the side lay.

BRIEF DESCRIPTION OF THE DRAWINGS

FIG. 1 is a block diagram showing an arrangement according to an embodiment of the present invention;

FIGS. 2 and 3 are views respectively showing operation panels;

DESCRIPTION OF THE PREFERRED EMBODIMENT

Figure 4:
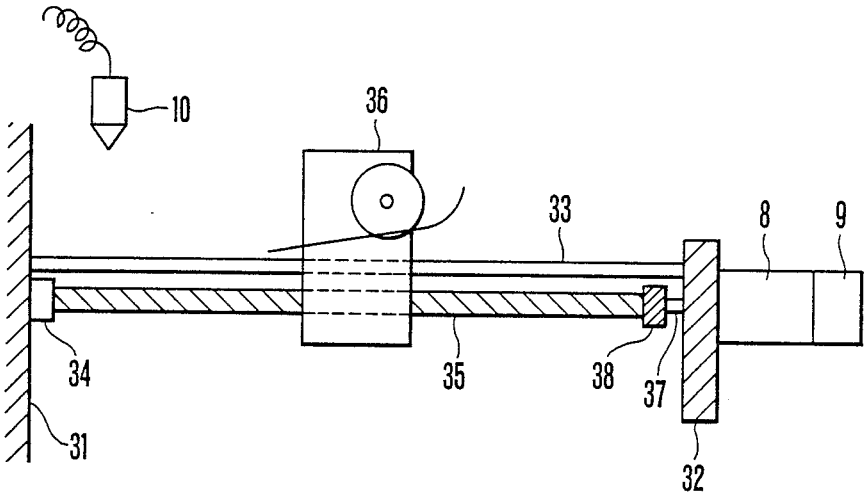
FIG. 4 is a partially cutaway, sectional, front view showing one side lay.

An embodiment of the present invention will now be described with reference to the accompanying drawings.

FIG. 1 shows an arrangement according to an embodiment of the present invention. In FIG. 1, a processor such as a microprocessor (to be referred to as a CPU hereinafter) 1, a memory (to be referred to as an MM hereinafter) 2 comprising a ROM (Read-Only Memory) and a RAM (Random Access Memory), an operation panel (to be referred to as an OP hereinafter) 3, interfaces (to be referred to as I/Fs hereinafter) 4 and 5 are connected through a bus 6. The I/F 4 is connected to a motor (to be referred to as an M hereinafter) 8, an encoder (to be referred to an an E hereinafter) 9, and a sensor 10 through a driver (to be referred to as a DR hereinafter) 7. The CPU 1 executes an instruction stored in the MM 2, and performs a control operation while accessing necessary data stored in the MM 2. The CPU 1 drives the M 8 through the I/F 4 in accordance with the output from the OP 3, and determines a drive condition of the M 8 in accordance with the outputs from the E 9 and the sensor 10. The addition, the CPU 1 sends a signal representing theh drive condition to the OP 3 to cause the OP 3 to perform a display using its indication lamp.

Note that the I/F 5 is also connected to the DR 7, the M 8, the E 9, and the sensor 10. The I/Fs 4 and 5 and the componnts connected thereto are arranged in correspondence with right and left side lays. The OP 3 is divided into two surfaces, which correspond to a paper feed side and a paper delivery side of the printing press, respectively.

FIG. 2 shows an OP 3*a* on the paper feed side. The OP 3*a* is arranged on a printing press end portion or the like on the side where a paper sheet sheet feeder is connected, and comprises a switch 11, e.g., a digitial switch, for setting a paper size to be used on the order of 0.1 mm, a switch 12 for selecting the right and left side lays and for canceling all designation, and a switch 13 for instructing a start of a control operation. In addition, the OP 3*a* comprises indicaiton lamps 14 and 15 which are turned on in accordance with designation of the switch 12, and an indication lamp 16 for urging an operator to confirm whether or not an obstacle is present on moving parts of the side lays before the side lays begin to move.

FIG. 3 shows an OP 3*b* provided at a printing press end portion or the like on a side where printed paper is delivered. The OP 3*b* comprises a switch 21, similar to the switch 11, for setting a fine adjstment length and also setting its diretion using "+" or "−", and a switch 22 similar to the switch 13. The OP 3*b* also comprises arrow-like indication lamps 23 and 24 inndicating the direction set by the switch 21.

The direction of the fine adjustment length is opposite to the moving direction of the side lay, and a direction along which a printed image is moved along a paper surface is directly indicated in accordance with the paper position according to the side lay position, thus preventing an operation error.

FIG. 4 shows one of the right and left side lays. In FIG. 4, a guide rail 33 and a feed screw 35 which is rotatably supported by a bearing 34 horizontally extend between a frame 31 of the printing press and an opposing mounting plate 32. A side lay unit 36 which is slidably engaged with the guide rail 33 and threadably engaged with the feed screw 35 is supported on the guide rail 33 and the feed screw 35. Since a shaft 37 of the M 8 fixed to the nounting plate 32 and the feed screw 35 are coupled through a universal coupling 38, the side lay unit 36 is driven in accordance with normal or reverse rotation of the N 8 to be moved to the right or left in FIG. 4.

The M 8 is conneted to the E 9 such as a rotary encoder, and outputs a pulse signal in accordance with normal or reverse rotation of the M 8. The sensor 10, using e.g., a proximity switch, for detecting that the side lay unit 36 is returned to the home position is arranged at a home position on the side of the frame 31 to which the side lay unit 36 is returned.

Figure 5:
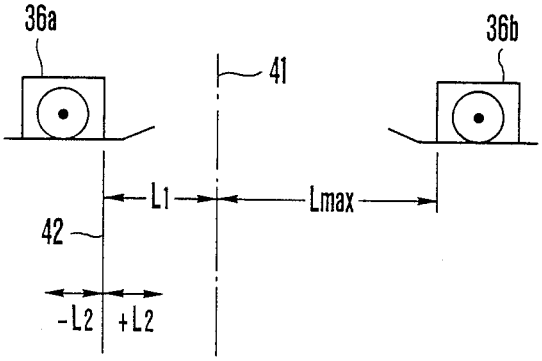
FIG. 5 is a view showing right and left side lays.

FIG. 5 shows side lay units 36*a* and 36*b* when viewed from the paper sheet feeder. When the central line in the right-and-left direction of the printing system is defined as a reference point 41, and a distance from the reference point 41 to a papr side edge portion 42 of the left side by unit 36*a* is given by a distance $L_1$, a fine adjustment length $+L_2$ or $-L_2$ is determined with reference thereto. These lengths are set by the swtich 11 shown in FIG. 2 and the switch 21 shown in FIG. 3.

Note that when the side lay units 36*a* and 36*b* are returned to the home positions corresponding to the sensors 10 shown in FIG. 4, a distance to the reference point 41 is given by Lmax.

Figure 6:
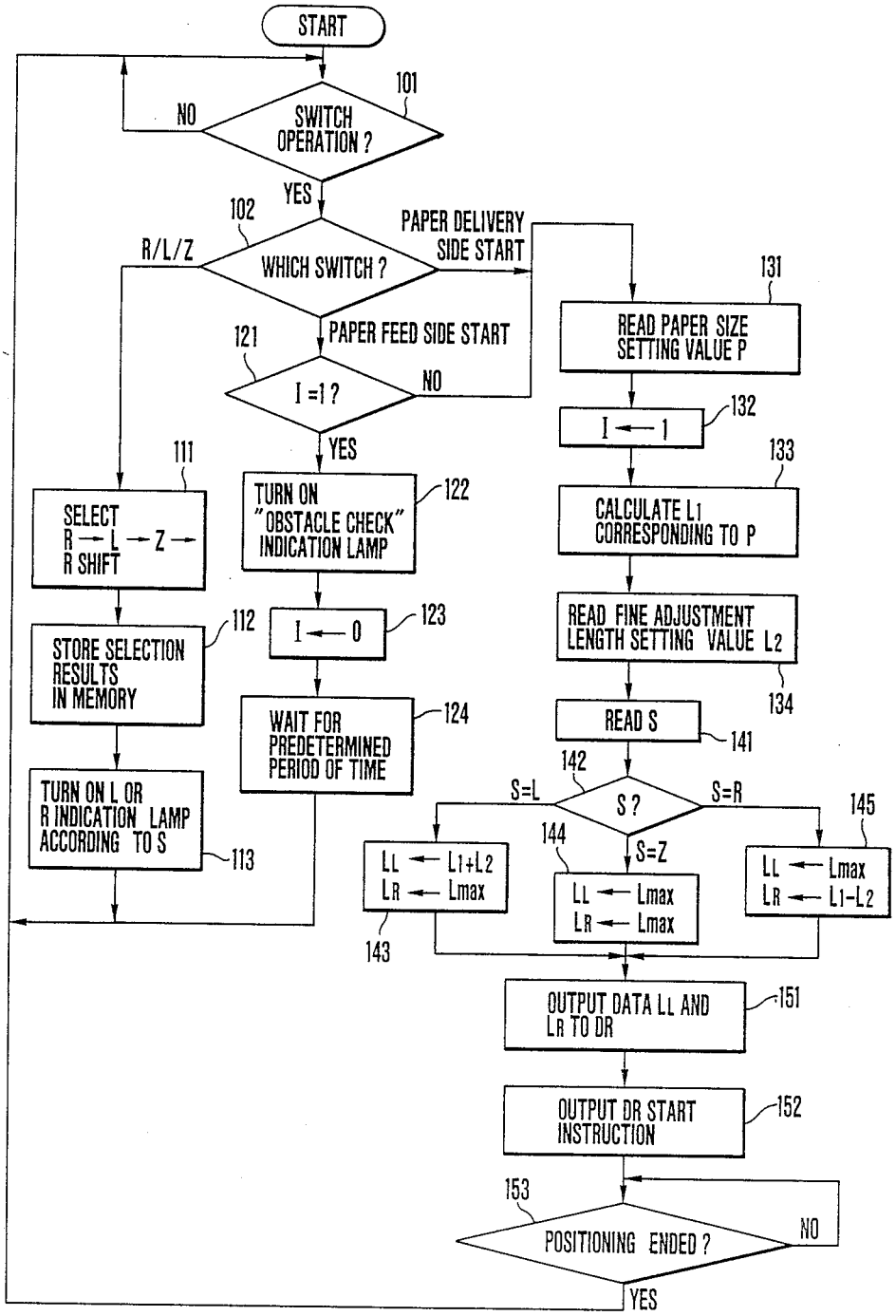
FIG. 6 is a flow chart showing control procedures.

FIG. 6 is a flow chart showing a control procedure executed by the CPU 1 in accordance with the operations at the OPs 3*a* and 3*b*. If Y (YES) in step 101 "SWITCH OPERATION?", step 102 "WHICH SWITCH?" is executed. If the "R/L/Z" switch 12 shown in FIG. 2 is operated, designation states of the left side R, right side L, and non-selection Z are sequentially and repetitively selected in accordance with step 111 "SELECT R→L→Z→R SHIFT". After a selection result S is stored in the MM 2 in step 112 "STORE SELECTION RESULT S IN MEMORY", and step 113 "TURN ON L OR R INDICATION LAMP ACCORDING TO S" is executed, thus turning on the indication lamp 14 or 15 shown in FIG. 2. Thus, one of the side lay units 36*a* and 36*b* to be controlled is indicated, and step 101 and the subsequent steps are repeated.

If "Z" is selected as the selection result S, no control is made, and both the ineication lamps 14 and 15 are turned off.

If the result in step 102 indicates the "PAPER FEED START" switch 13 shown in FIG. 2, step 121 "i=1?" is executed to check if a flag i=1. If Y in step 121, the indication lamp 16 shown in FIG. 2 is turned on in step 122 "TURN ON 'OBSTACLE CHECK' INDICATION LAMP", thus urging the operator to check if an obstacle is present on the moving path of the side lay unit 36. In step 123 "i←0", the flag is reset. Step 124 "WAIT FOR PREDETERMINED PERIOD OF TIME" for checking is executed for, e.g., several seconds using an internal timer of the CPU 1 in response to step 122. Thereafter, the flow returns to step 101.

If the "PAPER DELIVERY SIDE START" switch shown in FIG. 3 is detected in step 102, a paper size setting value P by the switch 11 shown in FIG. 2 is read in step 131 "READ PAPER SIZE SETTING VALUE P", and the flag is set in step 132 "i←1" in response to step 121. Then, step 133 "CALCULATE $L_1$ CORRESPONDING TO P" is executed, thereby calculating the distance $L_1$ shown in FIG. 5. Furthermore, step 134 "READ FINE ADJUSTMENT SETTING VALUE $L_2$" by the switch 21 shown in FIG. 3 is executed in the same manner as in step 131.

The result selected in step 111 is read out from the MM 2 in step 141 "READ S", and its content is checked in step 142 "S?". If the content is "S=L", an actual distance $L_L$ with respect to the reference point 41 of the left side lay unit 36*a* is determined by calculations, and an actual distance $L_R$ to the right side lay unit 36*b* is also determined as Lmax in step 143 "$L_L \leftarrow L_1+L_2$, $L_R \leftarrow$ Lman". If "S=Z" in step 142, the home positions are set in step 144 "$L_L \leftarrow$ Lmax, $L_R \leftarrow$ Lman". If "S=R" in step 142, the actual distances $L_L$ and $L_R$ are determined to have a positional relationship opposite to step 143 in step 145 "$L_L \leftarrow$ Lmax, $L_R \leftarrow L_1-L_2$". Thereafter, step 151 "OUTPUT DATA $L_L$ AND $L_R$ TO DR" through the I/Fs 4 and 5 is executed. Similarly, step 152 "OUTPUT START INSTRUCTION TO DR" is executed.

Then, a drive signal is output from the DR 7 according to step 152, the M 8 is rotated in the normal or reverse direction, and the side lay units 36*a* and 36*b* begin to move to the predetermined positions. Thus, step 153 "POSITIONING ENDED?" is executed based on a pulse signal from the E 9 or the detection output from the sensor 10. If Y in step 153, a series of control operations are completed, and the flow returns to step 101.

In step 143, the actual distance $L_L$ with respect to the reference point 41 of the side lay unit 36*a* is defined by $L_1+L_2$, and the actual distance of the side lay unit i36*b* is defined by Lmax. In step 145, the actual distances are similarly determined. Thus, the positions of the units 36*a* ane 36*b* are determined in accordance with the paper size and the printing condition.

More specifically, the paper size is set by the switch shown in FIG. 2, a fine adjustment length is set by the switch 21 shown in FIG. 3 in accordance with the relative positional relationship between an image on the printing plate and the paper checked by test printing. The side lay positions are automatically determined so that the image can be printed at an optimal position on the paper. Thus, adjustment of the side lay positions can be quickly and easily performed. As a result, a time required for adjusting the side lay positions can be shortened, and test printing paper can be saved.

Since the setting direction of the fine adjustment length by the switch 21 coincides with the moving direction of the image to be printed on the paper, the position of the printed image can be surely and easily corrected without causing an operation error.

As the M 8, a pulse motor or DC or AC motor is used, and the arrangement of the DR 7 can be selected accordingly. The E 9 may employ a potentiometer, and the like a addition to the rotary encoder. The sensor 10 may employ a photoelectric switch, a mechanical switch, and the like in addition to the proximity switch. In FIGS. 2 and 3, a ten-key pad may be used as the switches 11 and 12, and various displays may be employed as the indication lamps 14, 15, 16, 23, and 24. Thus, various modifications are allowed.

According to the present invention as described above, the side lay position can be automatically adjusted in accordance with setting of a paper size and a fine adjustment length. Thus, a time required therefor can be shortened, and test printing paper can be saved. A printing operation can be facilitated, and high-speed operation can be achieved, thereby providing remarkable effects in various sheet-fed printing presses.

What is claimed is:

1. A side lay position control apparatus for a sheet-fed printing press, comprising:

setting means for setting a distance from a reference point of the sheet-fed printing press to a side lay and a fine adjustment length with reference to the distance;

calculating means for calculating an actual distance from the reference point to said side lay in accordance with the distance from the reference point to said side lay and the fine adjustment length; and drive means for moving said side lay in accordance with the actual distance.

2. An apparatus according to claim 1, further comprising display means for indicating values set by said setting means.

3. An appartus according to claim 2, wherein said setting means includes a switch.

* * * * *